United States Patent [19]

Seiki et al.

[11] 4,435,954

[45] Mar. 13, 1984

[54] FIBER OPENING DEVICE IN OPEN-END SPINNING UNIT

[75] Inventors: Kazuo Seiki, Kariya; Kozo Motobayashi, Aichi; Toshio Yoshizawa, Chiryu; Yoshiaki Yoshida; Keiji Onoue, both of Toyota, all of Japan

[73] Assignee: Kabushiki Kaisha Toyoda Jidoshokki Seisakusho, Aichi, Japan

[21] Appl. No.: 333,443

[22] Filed: Dec. 22, 1981

[30] Foreign Application Priority Data

Dec. 27, 1980 [JP] Japan ..... 55-185105

[51] Int. Cl.[3] ..... D01H 7/882; D01H 7/892

[52] U.S. Cl. ..... 57/408; 57/404

[58] Field of Search ..... 57/404, 406, 408–413

[56] References Cited

U.S. PATENT DOCUMENTS 4,024,699 5/1977 Goldammer et al. ..... 57/408 X 4,246,745 1/1981 Rehm et al. ..... 57/408

*Primary Examiner*—John Petrakes

*Attorney, Agent, or Firm*—Brooks, Haidt, Haffner & Delahunty

[57] ABSTRACT

In a fiber opening device in open-end spinning unit, having a combing roller which is encased by a casing and forming a fiber transferring passage between said combing roller and said casing, a wear-resistant member, preferably a member having a pin shape, is provided at an edge of an opening, e.g. a trash exit port opening formed in said casing and communicated with said passage. The structure of the fiber opening device according to the present invention makes possible easy installation of the wear-resistant member, and prevents harmful wear or bruising at said edge portion of the opening in the casing.

6 Claims, 7 Drawing Figures

FIBER OPENING DEVICE IN OPEN-END SPINNING UNIT

BACKGROUND OF THE INVENTION

The present invention relates generally to a fiber opening device having a combing roller encased by a casing in an open-end spinning unit, more specifically to a structure according to which a wear-resistant member is provided at edges of apertures formed in said casing and communicating with the fiber transferring passage formed by and between said combing roller and said casing.

In most designs of fiber opening devices in open-end spinning units, the casings are usually made of aluminium diecastings. It has been known that the casing which is made of such comparatively soft material tends to allow development of rapid wear or bruises on the surfaces which are always subjected to contact with fibers or trash contained therein. The tendency of such wear or bruises is more remarkable at the edge portion formed downstream (with respect to the direction of fiber transferring) of the trash outlet port which is exposed to impingement action of the trash during spinning operation. The same tendency can be found at the edge portion provided at the mouth of the fiber supplying channel for peeling off the fibers from the combing roller.

If the edge portion of any aperture which is formed on the inner wall surface of the casing in the fiber opening device is worn and bruised, the flow of fibers through the fiber transferring passage is restricted by such flawed edge. Namely, those fibers which are caught by such edge act to hinder the flow or passage of the subsequent fibers, with the result that slubs are formed in the spun yarn and the yarn thus formed is rendered inevitably uneven in strength, thus causing serious deterioration to the spun yarn quality.

In order to solve the above problem, it has been contemplated heretofore that a wear-resistant ring, e.g. a ring made of steel, should be inserted in the casing.

To describe briefly the manner in which the fibers are moved in the opening device of a spinning unit, the fibers in the form of sliver are fed by the coacting feed roller and presser into the fiber transferring passage formed between the combing roller and the casing. In this passage, the fibers are transferred while being combed or opened-up by the rotating combing roller to the fiber feed channel, through which they are supplied to the spinning rotor.

The casing of such fiber opening device is formed with apertures as the trash receiving outlet port and fiber feeding channel, both of which are in communication with said fiber transferring passage and face the combing roller. In such structure of the casing, the edge on the downstream side of the trash outlet port and the fiber peeling edge of fiber feeding channel are placed under the influence of impinging pressure or impact exerted by the trash and fibers. Therefore, these edges in particular are susceptible to rapid wear and harmful bruises. In an attempt to avoid the development of such wear and bruises, the use of a wear-resistant ring on the inner wall surface of the casing has been proposed. Such a ring has been formed therein with apertures or openings which are adapted to match the corresponding ports formed on the inner wall surface of the casing, namely the trash outlet port, fiber feeding channel port, and the fiber entrance port adjacent the feed roller, respectively. However, it is extremely difficult to install such a ring within the casing in accurately-aligned relation thereto, as well as to manufacture the ring to such a tolerance that the mating apertures may match accurately to each other. Moreover, since the fiber opening device is always placed under the influence of constant vibration produced by the combing roller which rotates at a high speed, there is a fear that the ring may be loosened and slipped off a casing. Because the ring which is once removed in such a way receives serious flaws or deformation, it cannot be reused. Re-manufacturing of a new ring is costly, and the subsequent re-installation of the new ring calls for laborious procedures.

SUMMARY OF THE INVENTION

The object of the present invention is to eliminate the afore-mentioned problem by providing a wear-resistant member preferably in the form of a pin at any edge portion of the apertures formed on the inner wall surface of the casing and facing the combing roller of the fiber opening device in an open-end spinning unit, so that possible wear and bruising at such edge portion due to constant friction with the fibers and trash may be prevented successfully.

This and other objects and advantages of the present invention will become more apparent from the following description when taken in connection with the accompanying drawings which show and compare the conventional wear-resistant ring and the preferred embodiment of the invention.

DETAILED DESCRIPTION OF THE PREFERRED EMBODIMENT

Figure 1:
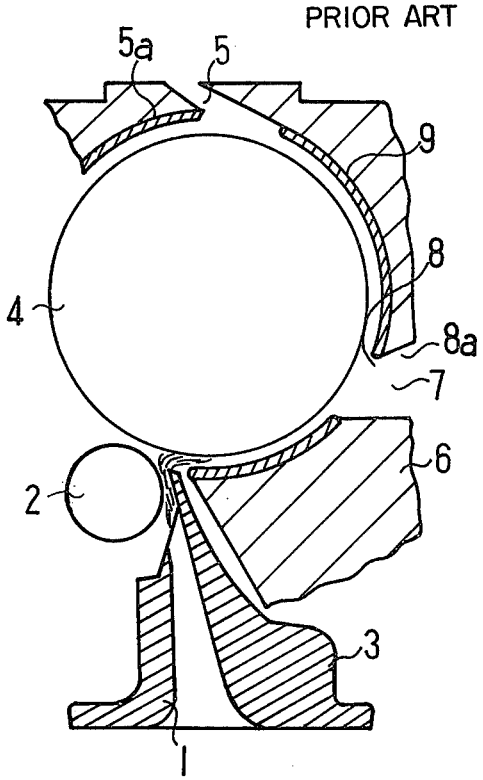
FIG. 1 PRIOR ART
FIG. 1 is a fragmentary sectional view of a fiber opening device in an open-end spinning unit and having a wear-resistant ring constructed in accordance with conventional design.

Referring to FIG. 1 which shows a well-known structure of a fiber opening device in an open-end spinning unit, a bundle of fibers moved past the condenser 1 is supplied by and between the feed roller 2 and the presser 3 to the combing roller 4, where the fibers are transferred while being separated or opened-up by the combing action of the rotating roller 4 and supplied finally to the spinning rotor (not shown) of the open-end spinning unit via the fiber feeding channel 5. In the casing 6 which encases the combing roller 4 thereby forming a fiber transferring passage therebetween, apertures or openings communicating with said passage are provided as the outlet port 7 for receiving trash or contaminants contained in the fibers and as said fiber feeding channel 5, respectively. In the structure of such fiber opening device, the edge 8*a* of the trash exit port 8 on the downstream side (with respect to the fiber transporting direction) and the fiber peeling edge 5*a* at the fiber feeding channel 5 are exposed to direct impingement action of fibers or trash and are, therefore subjected to rapid wear and bruising.

In the fiber opening device of the prior art as shown in FIG. 1, a member in the form of a ring 9 is inserted within the casing 6 on the inner peripheral wall surface thereof as a means for protecting the casing 6 against wear and bruising.

Figure 2:
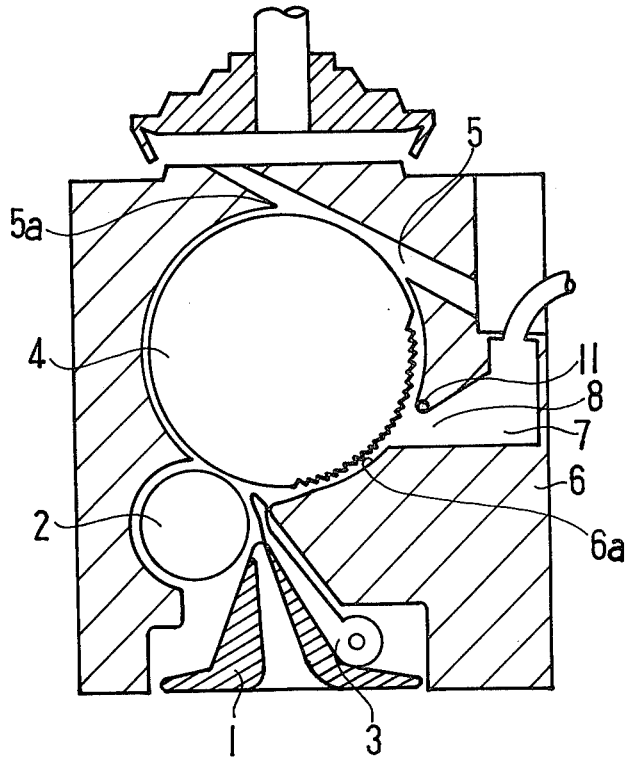
FIG. 2 is a sectional view of a fiber opening device constructed in accordance with the present invention.

FIG. 2 illustrates in cross-section an embodiment of a fiber opening device constructed in accordance with the present invention, wherein the like reference numerals indicate the like parts or members. As shown, the trash exit port 8 is formed on the inner peripheral surface of the casing 6 which encases the combing roller 4, at a location between the feed roller 2 and the fiber channel 5. Said trash outlet port 8 is continuous with the trash exhaust passage 7 which is in turn communicated with any suitable source of vacuum (not shown).

As the fibers are supplied by the feed roller 2 to the combing roller 4, they are placed under the influence of the combing action of said combing roller 4 having combing teeth thereon to be opened-up and are simultaneously transferred further by said teeth of the combing roller 4. At this time, the kinetic energy imparted by the rotating combing roller 4 to the trash or impurities contained in the fibers acts on the former to separate them from the latter, thus causing the trash to fly out tangentially to the combing roller 4 into the trash passage 7 through the trash exit port 8.

As is apparent from the configuration of the casing 9 of the fiber opening device shown in FIG. 2, the edge of trash outlet port 8 and the inner wall surface of trash exhaust passage 7 on the downstream side, respectively, are exposed at all times during the spinning operation to the damaging impact exerted by the trash being removed and thrown out from the fibers. Thus, such edge and wall surfaces are liable to be worn or bruised due to the impinging action of the trash. Wear or bruises on the wall surface of trash exhaust passage 7 will not affect the fibers, but the deformation at the edge of the trash outlet port 8 on the downstream side will badly affect the movement of the fibers being transported, because part of the fibers which are caught by the deformed edge will act to seize the fibers in the subsequent flow, thus affecting the smooth stream of fibers in the transferring passage.

With a view to eliminating such harmful influence on the fibers, the present invention contemplates providing a wear-resistant member 11 at the tip end of the downstream-side edge portion of the trash outlet port 8 in the fiber opening device. Such wear-resistant member 11 may be made of any suitable material having sufficient hardness for the wear-resisting purpose, including steels, ceramics, etc.

Figure 3:
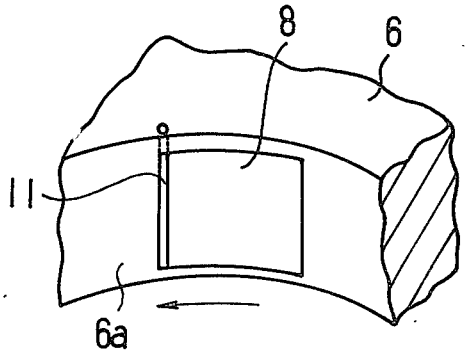
FIG. 3 is a perspective view showing the trash outlet port in the fiber opening device of FIG. 2.

As to the manner of installing this anti-wear member 11, any convenient method may be used provided that the edging member 11 can form a continuously smooth surface with the adjacent inner peripheral wall surface 6*a* of the casing 6 so that regular flow of fibers in the opening device may be not be prevented. As shown in FIG. 3, the wear-resistant edging member 11 is installed in such a way that it is extended over the entire width of the trash outlet port 8 on the downstream side in respect of the fiber movement as indicated by an arrow marking.

Figure 4:
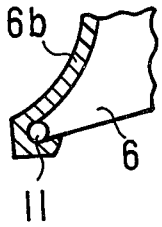
FIG. 4 is an enlarged view of an edge portion of the trash outlet port, showing a pin-shape edge member before it is provided according to the present invention.
Figure 5:
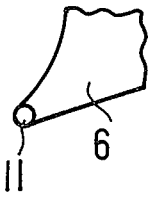
FIG. 5 is another enlarged view of the edge portion of FIG. 4, showing the pin-shape edge portion when it has been finished.

An edging member 11 in the shape of a straight pin can be fitted to place with ease. Such pin-shaped edging member 11 may be installed conveniently in the following steps of order: In initially forming the casing 6 itself by casting or in any other suitable forming methods, the edge portion of the casing 6 is formed with extra thickness as indicated by the hatched area 6*b* in FIG. 4. In the next step, a hole is made in the casing 6 at a location where the pin is to be inserted. Then, a pin as the wear-resistant edging member 11 is driven through the hole. The excess portion of the casing 6 at the edge is cut off and finally finished in such a way that the driven pin 11 may be exposed as shown in FIG. 5.

Figure 6:
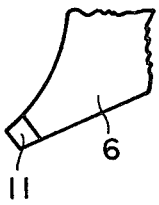
FIG. 6 is a view similar to FIG. 5, but showing a square-shaped edge member in accordance with the invention.
Figure 7:
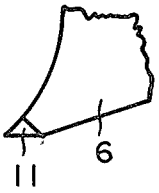
FIG. 7 is a view similar to FIGS. 5 and 6, but showing a triangular shaped edge member in accordance with the invention.

It should be understood that the form of the pin 11 in cross-section is not specifically limited to the invention. Any convenient section, e.g. round, square or triangular, may be selected as required as shown in FIGS. 5–7. When making a selection with emphasis on the ease of trash removal, however, a pin with triangular section is desirable for the purpose. Steel pins with round section which are readily available on the market may be used advantageously in terms of the cost involved.

Though the above-illustrated preferred embodiment of the invention has been centered on the description of providing a wear-resistant member 11 at the downstream edge of the trash exit port 8, the installation of such member 11 is not limited to the above edge, but the same member may be installed as required at other locations, e.g. at the fiber peeling edge 5*a*.

Thus, according to the present invention, it is possible to provide wear-resistant surfaces only where such wear-resisting quality is required, resulting in reduction of the cost involved in the manufacture of the casing for fiber opening device in an open-end spinning unit.

Because hard wear-resistant material is difficult to machine, it is not easy to obtain the desired degree of accuracy in forming a wear-proof ring having special configuration for the earlier-stated conventional fiber opening device, and therefore it is costly to manufacture such a ring. On the other hand, the present invention utilizes pins that are readily available on the market, thus featuring simplicity of structure, and is advantageous over the prior art in respect of the easy manner by which the desired accuracy can be achieved, thereby reducing manufacturing cost.

Furthermore, in installing the pin-shaped edging member according to the present invention, said pin member is driven into the hole formed adjacent to the excess thickness portion which has been formed previously at the edge portion of the casing, and then the excess portion is removed by any suitable means, followed by final finishing of the edge. In this way, the insertion of the pin can be performed with ease, calling for no laborious job.

What we claim is:

1. A fiber opening device for use in an open-end spinning unit, comprising a generally hollow cylindrical casing having a rotatable combing roller mounted therein, said casing having a fiber inlet port, a trash exit port, and a fiber feeding channel port through which a stream of opened fibers is discharged from said casing responsive to rotation of said combing roller, said ports being disposed in tandem spaced-apart relation along the interior periphery of said casing, and each of said ports providing an upstream edge and a downstream edge of the port respectively extending substantially across said interior periphery, and an elongated edging member of wear-resistant material attached to at least one of said port edges and substantially extending only along the length thereof.

2. A fiber opening device according to claim 1, wherein one of said edging members is attached to, and extends along said downstream edge of said trash exit port.

3. A fiber opening device according to claim 2, wherein said edging member attached to said edge of said trash exist port has triangular-shaped cross-section.

4. A fiber opening device according to claim 1, wherein at least one of said edging members has square-shaped cross-section.

5. A fiber opening device according to claim 1, wherein at least one of said edging members has round-shaped cross-section.

6. A fiber opening device according to claim 1, wherein at least one of said edging members has triangular-shaped cross-section.

* * * * *